US011464326B2

(12) United States Patent
Ramdass

(10) Patent No.: US 11,464,326 B2
(45) Date of Patent: Oct. 11, 2022

(54) PORTABLE LAPTOP STAND

(71) Applicant: Sumeet Ramdass, Murfreesboro, TN (US)

(72) Inventor: Sumeet Ramdass, Murfreesboro, TN (US)

( * ) Notice: Subject to any disclaimer, the term of this patent is extended or adjusted under 35 U.S.C. 154(b) by 0 days.

(21) Appl. No.: 17/215,487

(22) Filed: Mar. 29, 2021

(65) Prior Publication Data

US 2021/0298466 A1 Sep. 30, 2021

Related U.S. Application Data

(60) Provisional application No. 63/000,842, filed on Mar. 27, 2020.

(51) Int. Cl.
*A47B 21/02* (2006.01)
*A47B 96/06* (2006.01)

(52) U.S. Cl.
CPC ..... *A47B 21/02* (2013.01); *A47B 96/067* (2013.01)

(58) Field of Classification Search
CPC ..... A47B 23/041; A47B 5/00
USPC ..... 108/43, 152, 47, 48
See application file for complete search history.

(56) References Cited

U.S. PATENT DOCUMENTS 397,108 A * 2/1889 Brown et al. ..... A47B 23/002 108/43
1,624,862 A * 4/1927 Elliot ..... 108/96
2,304,705 A * 12/1942 Pate ..... A47G 23/06 224/258
3,009,613 A * 11/1961 Noland ..... A47G 23/06 224/265
3,090,330 A * 5/1963 Best ..... A45F 5/00 108/43
3,541,976 A * 11/1970 Rozas ..... A47B 23/002 108/43
4,715,293 A * 12/1987 Cobbs ..... A47B 23/002 108/43
5,074,222 A * 12/1991 Welch ..... A47B 23/002 108/43
5,104,080 A * 4/1992 Berger ..... A47J 37/0786 108/152
5,221,032 A * 6/1993 Bott ..... A45F 5/00 108/43
5,370,060 A * 12/1994 Wang ..... B60N 3/004 108/149
5,381,738 A * 1/1995 Meyer ..... A47B 5/00 108/108
5,421,499 A * 6/1995 Bauer ..... A47B 23/002 108/43
5,692,815 A * 12/1997 Murphy ..... G06F 3/0395 312/283
5,850,956 A * 12/1998 Hayward, Jr. ..... A47G 23/06 224/270
6,006,970 A 12/1999 Piatt
(Continued)

*Primary Examiner* — Jose V Chen
(74) *Attorney, Agent, or Firm* — Boudwin Intellectual Property; Daniel Boudwin

(57) ABSTRACT

A portable laptop stand defines a support platform. A pair of horizontal support arms are placed on an underside surface of the support platform. The pair of horizontal support arms are attached to a pair of vertical support arms. The pair of horizontal support arms are adjustable relative to the pair of vertical support arms. The pair of vertical support arms define an interface. The interface is designed to attach the portable laptop stand to the wearer.

13 Claims, 3 Drawing Sheets

(56) References Cited

U.S. PATENT DOCUMENTS 6,053,383 A * 4/2000 Gunderson ..... A45F 3/14 108/43
6,381,127 B1 4/2002 Maddali et al.
6,679,188 B1 * 1/2004 Spagnoli, Jr. ..... B60N 3/004 108/152
6,682,038 B2 * 1/2004 Golynsky ..... A47B 21/0314 108/43
D558,974 S * 1/2008 Denzer ..... D3/215
7,658,153 B1 * 2/2010 Patoka ..... B60R 11/00 108/44
7,780,049 B1 * 8/2010 Baranoski ..... A45F 3/14 224/250
7,806,305 B1 * 10/2010 Moore, Jr. ..... A45F 5/00 224/265
8,109,421 B2 * 2/2012 McLean ..... A45C 13/30 224/270
8,322,290 B1 * 12/2012 Mignano ..... A47B 23/043 108/9
8,418,629 B2 * 4/2013 Yu ..... F16M 13/04 108/43
8,567,325 B1 * 10/2013 Hlatky ..... A47B 9/14 108/134
D697,708 S * 1/2014 Denzer ..... D3/215
8,807,052 B2 * 8/2014 Ehrlich ..... A47B 23/00 108/43
9,003,978 B1 * 4/2015 Fabricatore ..... F16M 13/00 108/43
9,004,330 B2 * 4/2015 White ..... F16M 13/04 224/257
9,103,491 B2 * 8/2015 Mak ..... F16M 13/04
9,504,300 B1 11/2016 Donahue
9,856,895 B2 * 1/2018 Kieley ..... F16M 13/022
10,317,941 B2 6/2019 Janowski et al.
2007/0051766 A1 * 3/2007 Spencer ..... A45C 11/00 224/607
2007/0164987 A1 * 7/2007 Graham ..... A45F 5/00 345/156
2007/0227923 A1 * 10/2007 Kidakarn ..... G06F 1/1681 206/320
2008/0121730 A1 * 5/2008 Calkin ..... A45F 3/06 238/12
2009/0272779 A1 * 11/2009 Vu ..... A45F 5/00 224/677
2013/0192498 A1 * 8/2013 Bullock ..... A47B 23/044 108/43
2013/0214022 A1 * 8/2013 Harvey ..... F16M 11/041 224/623
2014/0216306 A1 8/2014 Allen et al.

* cited by examiner

PORTABLE LAPTOP STAND

CROSS REFERENCE TO RELATED APPLICATIONS

This application claims the benefit of U.S. Provisional Application No. 63/000,842 filed on Mar. 27, 2020. The above identified patent application is herein incorporated by reference in its entirety to provide continuity of disclosure.

BACKGROUND OF THE INVENTION

The present invention relates to a portable laptop stand. More specifically, the present invention provides a laptop stand that may be secured to the wearer in a comfortable and effective manner to enable use of a laptop in an otherwise unsuitable environment.

Many individuals use laptop computers, or other similar devices, in their daily lives. Portable electronic devices are a not only a common and necessary tool for several occupations, but also can be a source of communication, entertainment and research. Transporting and utilizing these devices can be difficult in many situations. Specifically, in areas with limited space, limited seating or a lack of tables it may be difficult for technology owners to utilize their devices. For example, airports, train stations, malls and the like may be crowded, leaving individuals without a seating area. Available areas could also be dirty or unsanitary, and could lead to unpleasant situations for both the user and the electronic device. Furthermore, individuals in such settings may desire to easily move from one area to another for privacy or to avoid loud or unpleasant noises.

Currently, many electronic devices are designed to be compact, however, this can limit the functionality of the device itself. Additionally, these design efforts still can require two hands for operation. Holding these devices, which are usually bulky to some extent, while also using them can be difficult or impossible without a surface on which to work.

Therefore, there is a defined need amongst the known prior art references for a device that will assist users in operating a laptop computer, or electronic device, in a setting that does not provide otherwise provide adequate support. Ideally, the solution will provide an efficient, effective alternative to known methods and devices.

SUMMARY OF THE INVENTION

In view of the foregoing disadvantages inherent in the known types of laptop stands now present in the prior art, the present invention provides a portable laptop stand wherein the same can be utilized for providing convenience for the user when providing a portable surface for a laptop to rest upon.

The present system comprises a support platform. A pair of horizontal support arms are disposed on an underside surface of the support platform. The horizontal support arms provide horizontal support to the support platform. The portable laptop stand further comprises a pair of vertical support arms. The vertical support arms provide vertical support to the horizontal support arms and the support platform. The pair of horizontal support arms is attached at a pair of distal ends to the pair of vertical support arms. The pair of horizontal support arms are adjustable relative to the pair of vertical support arms, such that the user may adjust the height of the support platform. The pair of vertical support arms define an interface on a rear surface, opposite the support platform, such as to allow for the user to secure the portable laptop stand to himself or herself.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
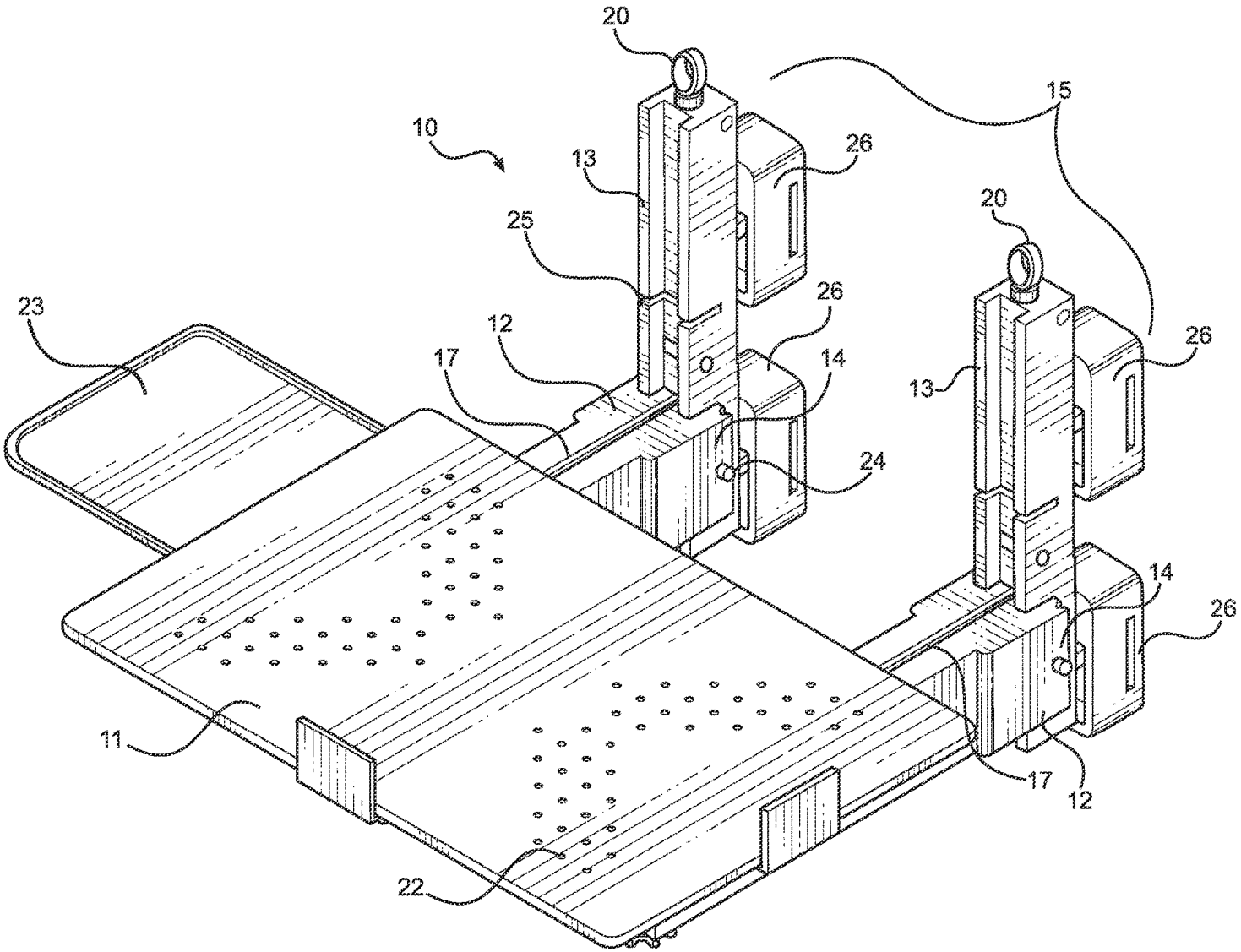
FIG. 1 shows a perspective view of an embodiment of the portable laptop stand.

Reference is made herein to the attached drawings. Like reference numerals are used throughout the drawings to depict like or similar elements of the portable laptop stand. The figures are intended for representative purposes only and should not be considered to be limiting in any respect.

Referring now to FIG. 1, there is shown a perspective view of an embodiment of the portable laptop stand. The portable laptop stand 10 comprises a support platform 11. The support platform 11 is configured to receive an electronic device, such as a laptop computer, thereon. In some embodiments, the support platform 11 is made of a rigid material. Structurally, the support platform 11 is rectangular in shape with rounded corners, in the demonstrated embodiment. However, in alternate embodiments, the support platform may be of a different shape.

A pair of horizontal support arms 12 are disposed on an underside surface of the support platform 11. In some embodiments, the support platform 11 is slidable along a top surface of the pair of horizontal support arms 12. For example, in the demonstrated embodiment, a channel 17 is defined on each top surface of each horizontal support arm of the pair of horizontal support arms 12.

The portable laptop stand 10 further comprises a pair of vertical support arms 13. The pair of horizontal support arms 12 are attached at a pair of distal ends 14 to the pair of vertical support arms 13. In the illustrated embodiment, the pair of horizontal support arms 12 are perpendicularly engaged with the pair of vertical support arms 13. The pair of horizontal support arms 12 are adjustable relative to the pair of vertical support arms 13. As such, the user will be able to adjust the height of the support platform 11 to enable use in different positions, such as sitting and standing, for example.

The pair of vertical support arms 13 define an interface 15 on a rear surface of the pair of vertical support arms 13, opposite the support platform 11. The interface 15 is configured to allow for the user to secure the portable laptop stand 10 to his or her person. In the illustrated embodiment, the interface 15 comprises a pair of eyelets 20. The pair of eyelets 20 are disposed on a top surface of the pair of vertical support arms 13. The pair of eyelets 20 provide an opening for which a user may secure a strap or similar device, allowing for the user to wear the portable laptop stand 10. Furthermore, in the demonstrated embodiment, the interface 15 comprises a plurality of brackets 26. The plurality of brackets 26 are disposed on a rear surface of the pair of vertical support arms 13. The plurality of brackets 26 comprise one or more slots configured to receive a strap or similar device therethrough, allow for the user to secure the portable laptop stand 10 to their body.

The position of the pair of horizontal support arms 12 relative to the vertical support arms 13 may be further securable via a pair of fasteners 24. The pair of fasteners 24 may be of any suitable configuration for securing the pair of horizontal support arms 12 to the pair of vertical support arms 13. In the illustrated embodiment, the pair of fasteners 24 are a pair of support pins. The pair of support pins may be fully removable from the pair of vertical support arms 13 and the pair of horizontal support arms 12 such as to enable full disassembly. Additionally, to provide further stability, the pair of vertical support arms 13 may comprises a plurality of slots 25 defined therein. The plurality of slots 25 are configured to receive a portion of the pair of horizontal support arms 12 therein.

In the illustrated embodiment, the support platform 11 comprises a plurality of ventilation apertures 22. The plurality of ventilation apertures 22 are disposed through the support platform. In the illustrated embodiment, the plurality of ventilation apertures 22 are placed in a pair of opposing patterns on the opposing sides of the support platform 11. Functionally, the plurality of ventilation apertures 22 are configured to provide ventilation to an electronic device, such as a laptop, that is placed on the support platform 11. Many electronic devices generate heat during their regular use. The plurality of ventilation apertures 22 provide an escape for this heat that prevents overheating the device or heating the support platform 11.

In some embodiments, the portable laptop stand 10 comprises an auxiliary platform 23. The auxiliary platform 23 is disposed on a side of the support platform 11 and is configured to provide an additional surface for the user. For example, the user may utilize the auxiliary platform 23 as a surface on which to operate a computer mouse that is connected to the electronic device. Ideally, the auxiliary platform 23 will be movable or retractable between a deployed position and a stored position.

Figure 2:
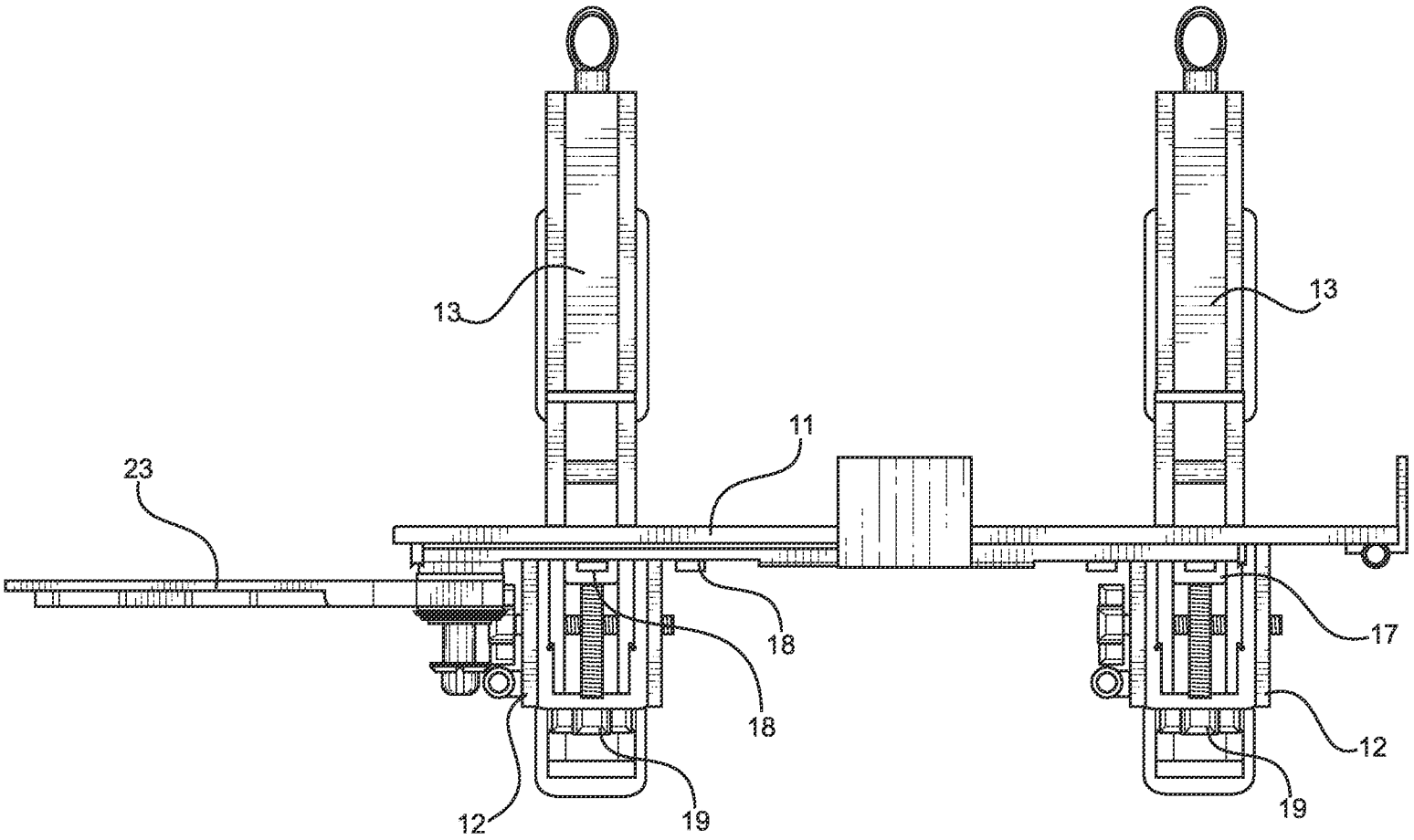
FIG. 2 shows a front view of an embodiment of the portable laptop stand.

Referring now to FIG. 2, there is shown a front view of an embodiment of the portable laptop stand. In the illustrated embodiment, the auxiliary platform 23 is pivotally connected to the underside surface of the support platform 11. As such, the auxiliary platform 23 may be swung or rotated into the deployed position. The deployed position is defined where a portion of the area of the auxiliary platform 23 is defined aside from the area of the support platform 11. The stored position is defined where the area of the auxiliary platform 23 is entirely disposed beneath the support platform 11.

As shown in the illustrated embodiment, a plurality of tracks 18 are disposed on an underside surface of the support platform 11. The plurality of tracks 18 are dimensioned to rest within the pair of channels 17 defined on the top surface of each horizontal arm of the pair of horizontal support arms 12. The plurality of tracks 18 may be defined such that the user may adjust the distance between the pair of vertical support arms 13. As such, the user may adjust the portable laptop stand 10 to a preferred, comfortable width.

Furthermore, in the illustrated embodiment, a pair of position pins 19 are provided. The pair of position pins 19 are configured to secure the support platform 11 to the pair of horizontal support arms 12. In the specific demonstration, the pair of position pins 19 are a pair of threaded screw members. The heads of the threaded screw members comprise a notched interface to assist the user in tightening and loosening the pair of position pins 19.

Figure 3:
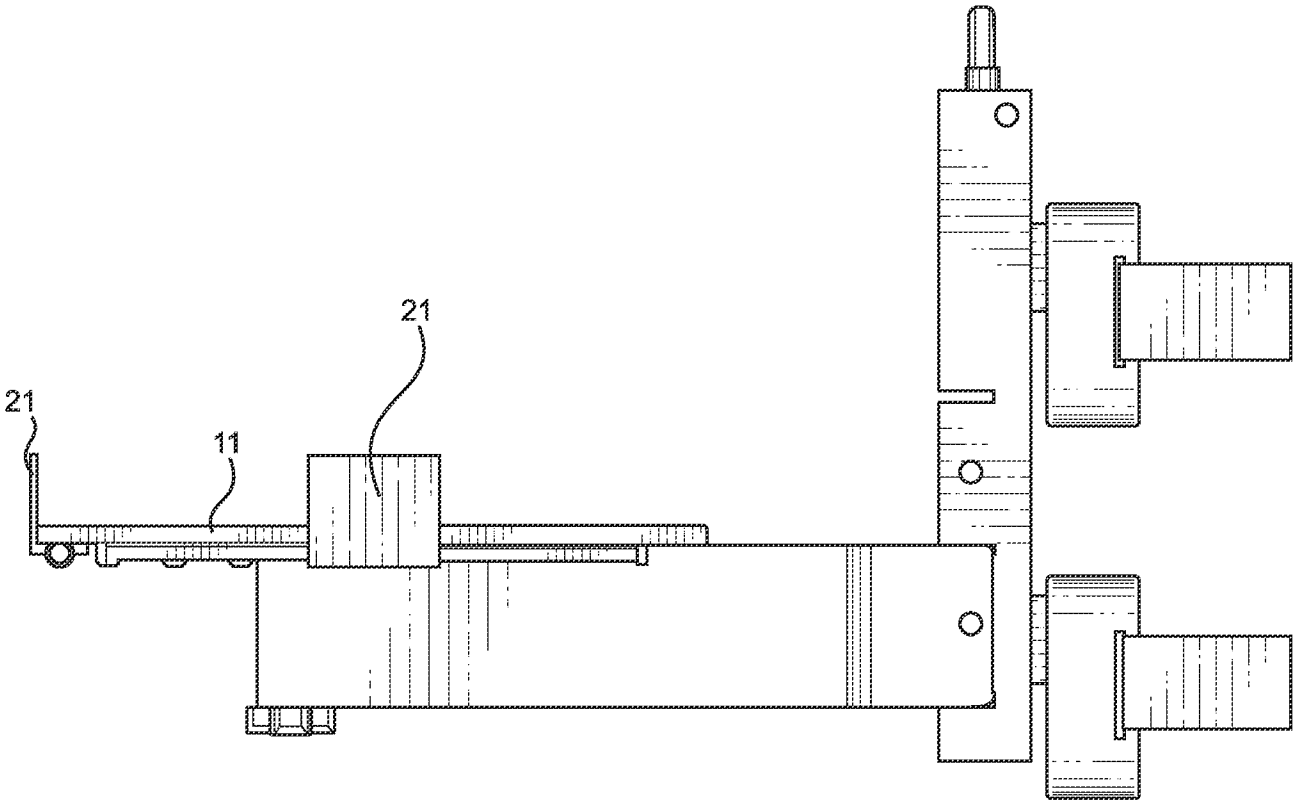
FIG. 3 shows a first side view of an embodiment of the portable laptop stand.

Referring now to FIG. 3, there is shown a side view of an embodiment of the portable laptop stand. In the illustrated embodiment, at least one tab 21 is disposed on a perimeter of the support platform 11. In the specific embodiment that is shown, a first tab is disposed on a front edge of the support platform 11 and a second tab is disposed on a side edge of the support platform 11. The at least one tab 21 prevents an electronic device, such as a laptop, from falling off of the support platform 11.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable laptop stand, comprising:

a support platform;

a pair of horizontal support arms disposed on an underside surface of the support platform;

a pair of vertical support arms;

the pair of horizontal support arms attached at a pair of distal ends to the pair of vertical support arms;

the pair of horizontal support arms being adjustable relative to the pair of vertical support arms;

the pair of vertical support arms defining an interface on a rear surface thereof opposite the support platform;

the interface configured to secure the portable laptop stand to a user's body;

the pair of horizontal support arms each comprising a channel disposed on the top surface of each horizontal support arm;

a plurality of tracks disposed on an underside surface of the support platform;

wherein the pair of channels are configured to removably receive a pair of tracks of the plurality of tracks.

2. The portable laptop stand of claim 1, wherein each horizontal support arm is disposed perpendicularly to a corresponding vertical support arm.

3. The portable laptop stand of claim 1, wherein the support platform is slidable along a top surface of the pair of horizontal support arms.

4. The portable laptop stand of claim 1, further comprising a pair of position pins configured to secure the position of the support platform relative to the pair of horizontal support arms.

5. The portable laptop stand of claim 1, wherein the interface comprises a pair of eyelets disposed on a top surface of the pair of vertical support arms.

6. The portable laptop stand of claim 1, wherein the interface comprises a plurality of brackets disposed on a rear surface of the pair of vertical support arms.

7. The portable laptop stand of claim 1, further comprising at least one tab disposed on a perimeter of the support platform.

8. The portable laptop stand of claim 1, further comprising a plurality of ventilation apertures disposed through the support platform.

9. The portable laptop stand of claim 1, further comprising an auxiliary platform.

10. The portable laptop stand of claim 9, wherein the auxiliary platform is pivotally connected to an underside surface of the support platform.

11. The portable laptop stand of claim 1, wherein a pair of fasteners is configured to secure the pair of horizontal support arms to the pair of vertical support arms.

12. The portable laptop stand of claim 11, wherein the pair of fasteners is a pair of support pins.

13. The portable laptop stand of claim 1, wherein the pair of vertical support arms define a plurality of slots dimensioned to receive the pair of horizontal support arms.

* * * * *